US010041508B2

(12) United States Patent
Schmollngruber et al.

(10) Patent No.: US 10,041,508 B2
(45) Date of Patent: Aug. 7, 2018

(54) HYDRAULIC UNIT

(71) Applicant: Weber-Hydraulik GmbH, Losenstein (AT)

(72) Inventors: Johann Schmollngruber, Grossraming (AT); Johann Auer, Losenstein (AT); Hans-Wilhelm Weiss, Wutach (DE)

(73) Assignee: Weber-Hydraulik GmbH, Losenstein (AT)

( * ) Notice: Subject to any disclaimer, the term of this patent is extended or adjusted under 35 U.S.C. 154(b) by 386 days.

(21) Appl. No.: 14/876,915

(22) Filed: Oct. 7, 2015

(65) Prior Publication Data

US 2016/0102687 A1 Apr. 14, 2016

(30) Foreign Application Priority Data

Oct. 8, 2014 (AT) ..... A 50717/2014

(51) Int. Cl.
*F15B 11/17* (2006.01)
*F15B 13/06* (2006.01)
*F15B 11/16* (2006.01)

(52) U.S. Cl.
CPC ..... *F15B 13/06* (2013.01); *F15B 11/161* (2013.01); *F15B 11/165* (2013.01);
(Continued)

(58) Field of Classification Search
CPC ..... F15B 2211/20584; F15B 11/17; F15B 2211/25076; F15B 2211/4053;
(Continued)

(56) References Cited

U.S. PATENT DOCUMENTS 3,723,026 A 3/1973 Soyland et al.
3,924,971 A * 12/1975 Jacquot ..... F04B 49/007 417/286

(Continued)

FOREIGN PATENT DOCUMENTS

DE 2 117 527 A1 11/1971
EP 1 084 349 B1 11/2002

(Continued)

*Primary Examiner* — Thomas E Lazo
*Assistant Examiner* — Dustin T Nguyen
(74) *Attorney, Agent, or Firm* — Collard & Roe, P.C.

(57) ABSTRACT

A hydraulic unit includes two pressure connections for supplying devices, in particular hydraulic rescue devices, including a first hydraulic circuit with a first pump arrangement and a first pressure connection and a second hydraulic circuit with a second pump arrangement and a second pressure connection, wherein the pump arrangements are driven at the same time by a common drive, and wherein by a first valve switch the first hydraulic circuit can be connected to the second hydraulic circuit and by a second valve switch the second hydraulic circuit can be connected to the first hydraulic circuit. The valve switches include a spring acting in the direction of an initial position and from the first hydraulic circuit or from the second hydraulic circuit a first control line runs to the first valve switch and from the second hydraulic circuit or from the first hydraulic circuit a second control line runs to the second valve switch.

15 Claims, 7 Drawing Sheets

(52) U.S. Cl.
CPC ..... *F15B 11/166* (2013.01); *F15B 11/17* (2013.01); *F15B 2211/2053* (2013.01); *F15B 2211/20576* (2013.01); *F15B 2211/20584* (2013.01); *F15B 2211/20592* (2013.01); *F15B 2211/251* (2013.01); *F15B 2211/252* (2013.01); *F15B 2211/255* (2013.01); *F15B 2211/405* (2013.01); *F15B 2211/4053* (2013.01); *F15B 2211/426* (2013.01); *F15B 2211/428* (2013.01); *F15B 2211/63* (2013.01)

(58) Field of Classification Search
CPC .. F15B 2211/40546; F15B 2211/41518; F15B 2211/20592
USPC ..... 60/421
See application file for complete search history.

(56) References Cited

U.S. PATENT DOCUMENTS

| | | | | | |
|---|---|---|---|---|---|
| 3,955,474 | A * | 5/1976 | Dunn | F15B 11/17 | 60/421 |
| 4,000,616 | A | 1/1977 | Symmank | | |
| 4,044,786 | A * | 8/1977 | Yip | F15B 11/162 | 137/101 |
| 4,633,666 | A | 1/1987 | Karakama | | |
| 6,578,357 | B1 * | 6/2003 | Schmollngruber | E21F 11/00 | 173/206 |
| 2003/0230082 | A1 * | 12/2003 | Wook Kim | E02F 9/2203 | 60/429 |
| 2007/0125078 | A1 | 6/2007 | Tanaka et al. | | |
| 2009/0056325 | A1 * | 3/2009 | Gary | E02F 9/2239 | 60/421 |
| 2014/0334955 | A1 * | 11/2014 | Kim | F04B 39/02 | 417/447 |

FOREIGN PATENT DOCUMENTS

| | | | |
|---|---|---|---|
| EP | 1 558 849 | B1 | 12/2007 |
| FR | 2 437 512 | A1 | 4/1980 |
| JP | S 51-101682 | A | 9/1976 |
| JP | S 58-213929 | A | 12/1983 |
| JP | S61-204427 | A | 9/1986 |
| JP | H 10-61608 | A | 3/1998 |

* cited by examiner

HYDRAULIC UNIT

CROSS REFERENCE TO RELATED APPLICATIONS

Applicant claims priority under 35 U.S.C. § 119 of Austrian Application No. A 50717/2014 filed on Oct. 8, 2014, the disclosure of which is incorporated by reference.

The invention relates to a hydraulic unit comprising at least two pressure connections as disclosed herein and a method for the required supply of one or more hydraulically driven devices with hydraulic fluid by means of a hydraulic unit as disclosed herein.

From the prior art hydraulic units are already known to which one or more hydraulic devices can be connected which are activated independently of one another and can also be charged with varying resistances. For example, such hydraulic units are often used for driving hydraulic recovery devices, in particular by a combustion engine drive, as the later enable the mobile and independent use of such devices. As during the simultaneous operation of two devices on a hydraulic circuit only the device with the lower operating resistance is driven, with such hydraulic units a separate hydraulic circuit with a separate pump is assigned to each pressure connection. In order to make better use of the drive power of a hydraulic unit and for the purpose of increasing the operating speed of a driven device it is known, by means of manual valves, to divert the volume flow of a hydraulic circuit, to which no device or an inactive device is connected, as necessary to a used device. Said switching processes are mostly performed by an individual operator in coordination with the users of the devices. If there are only a small number of staff there may not be an individual operator available for the hydraulic unit and therefore the required diversion of the volume flows during intermittent operation of the device cannot be performed.

The objective of the invention is to avoid the disadvantages of the prior art and provide a hydraulic unit with reduced operating requirements.

The objective of the invention is achieved by a hydraulic unit having the features disclosed herein.

Since the valve switches comprise a spring acting in the direction of an initial position and a first control line runs from the first hydraulic circuit or from the second hydraulic circuit to a first actuator acting on the first valve switch and a second control line runs from the second hydraulic circuit or from the first hydraulic circuit to a second actuator acting on the second valve switch, the required diversion of hydraulic fluid from one hydraulic circuit to the other hydraulic circuit is possible without the intervention of an operator and thereby the handling of such a hydraulic unit is improved considerably.

One embodiment is advantageous, in which the first and/or the second control line is designed as a hydraulic control line and acts directly or by means of an actuator in the form of a pilot valve on the second or first valve switch. The switching processes can thereby be triggered in a reliable manner, as the pressure in the individual hydraulic circuits provides an indicator of the respective operating status of a device.

It is possible additionally or alternatively, that the first and/or second control line is designed as an electric control line and by means of an electromagnetic actuator, in particular a magnetic coil, acts directly or via a pilot element, e.g. pilot valve on the second or first valve switch. In this case the operating state of the connected devices can be actively selected or determined by switches or sensors arranged thereon and used as a basis for switching processes. The switching signals can also be converted and processed by using a logic circuit.

To use the hydraulic unit at different pressure levels it is an advantage if the first pump elements comprise at least one high pressure element with a smaller conveying amount and at least one low pressure element with a larger conveying amount and the second pump elements comprise at least one high pressure element with a smaller conveying amount and at least one low pressure element with a larger conveying amount and the valve switches are arranged in the fluid lines coming from the low pressure elements. On increasing the pressure level in the connected devices the volume flow supplied to the latter can be reduced and thus the required power adjusted to the maximum output of the drive. The switching of the various pressure stages can be performed by means of pressure-controlled valve switches known from the prior art.

In order to achieve a high operating speed with low resistance in the devices it is possible that the conveying amount of the low pressure elements of a hydraulic circuit is at least double the conveying amount of the high pressure elements of the same hydraulic circuit. In this way, at a low pressure level a large volume flow can be provided at the pressure connections.

According one possible embodiment of the hydraulic unit, in the initial position of the valve switches a flow path from the respective fluid line of one hydraulic circuit to the connecting line to the other hydraulic circuit is opened. In this case generally a volume flow of the hydraulic fluid of a hydraulic circuit can be diverted to another hydraulic circuit and said volume flow is only recovered to a certain extent with an increase in pressure.

Furthermore, it is possible that the first connecting line runs from the first valve switch to the second valve switch and the second connecting line runs from the second valve switch to the first valve switch, wherein the second valve switch can produce a flow path from the first connecting line in a first switching position to a second fluid line leading to the second pressure connection or in an additional switching position to the fluid container and the first valve switch can produce a flow path from the second connecting line in a first switching position to a first fluid line leading to the first pressure connection or in a further switching position to the fluid container. For controlling the fluid flows there are thus additional options and the hydraulic unit can react better to the requirements of the devices.

In order even at a high pressure level in the hydraulic circuit of an operating device to use the unrequired volume flow of an additional hydraulic circuit, it is possible that a hydraulic circuit comprises at least two high pressure elements, at least one of which is connected via a fluid line directly to the pressure connection and at least one of which can be connected via the valve switch to another hydraulic circuit. In this embodiment both in the low pressure area and in the high pressure area the volume flows can be allocated as required and with optimized output.

Furthermore, it is possible to divert the entire volume flow of one hydraulic circuit to another hydraulic circuit, if all the first fluid lines can be connected by means of one or more first valve switches and by means of one or more first connecting lines or transfer lines to at least one second fluid line of the second hydraulic circuit and/or all second fluid lines by means of one or more second valve switches and by means of one or more second connecting lines or transfer lines to at least one first fluid line of the first hydraulic circuit. The operating status or the pressure level of a device no longer supplied with hydraulic fluid can no longer be determined by simple means, e.g. a control line of the hydraulic unit, therefore to reset the volume flow diversion other suitable measures have to be taken, e.g. a coordinated alternating operation of the devices, which can also be performed without an individual operator for the hydraulic unit. One option for switching the mode of operation could be that a signal for resetting the volume flow diversion is generated by the device not supplied with hydraulic fluid by means of a switch and an electric control line, whereby both devices are supplied simultaneously.

One way of achieving operation with a plurality of pressure stages is that in one of the fluid lines of a hydraulic circuit following a pump element a pressure switching valve is arranged, which is controlled by a pressure control line coming from another fluid line of the same hydraulic circuit, whereby with an increase in pressure in the other fluid line by the pressure switching valve a flow path is produced from the pump element to the fluid container. The conveying amount under high pressure can thereby be reduced in a simple manner and the power of the drive used optimally.

Structurally advantageous pump arrangements, which have proved particularly effective for mobile use, are obtained when the first pump elements and the second pump elements are arranged relative to one another in the manner of a radial piston pump.

It is possible to ensure a sufficient oil supply to the pump arrangements for the different applications if suction lines lead from the pump elements into the fluid container. The form and position of the fluid container can generally be freely selected in this case and can be operated with smaller filling amounts.

The objective of the invention is also achieved by a method for supplying one or more hydraulically driven devices, in particular hydraulic rescue devices, with hydraulic fluid by means of a hydraulic unit comprising at least two pressure connections as disclosed herein, in which in a first hydraulic circuit with a first pump arrangement by means of first fluid lines volume flows from at least two first pump elements are combined and directed to a first pressure connection and in a second hydraulic circuit with a second pump arrangement by means of second fluid lines the volume flows of at least two second pump elements are combined and directed to a second pressure connection, wherein the first pump elements and the second pump elements are driven at the same time by a common drive and wherein for the required allocation of the volume flows to the pressure connections by means of a first valve switch at least one of the first fluid lines is connected via a first connecting line to a second fluid line in the second hydraulic circuit and by means of a second valve switch at least one of the second fluid lines is connected via a second connecting line to a first fluid line in the first hydraulic circuit, wherein the valve switches are moved by means of a spring into a starting position and a switching process of the first valve switch is performed by a first actuator, which is controlled by a first control line coming from the first hydraulic circuit or the second hydraulic circuit and running to the first actuator, and a switching process of the second valve switch is performed by a second actuator, which is controlled by a second control line coming from the second hydraulic circuit or the first hydraulic circuit and running to the second actuator.

If in a hydraulic unit according to the invention both or a plurality of devices are activated, each of the devices is supplied automatically with half or a suitable proportion of the whole conveying volume, with only one activated device almost the whole conveying volume is supplied.

For a better understanding of the invention the latter is explained in more detail with reference to the following figures.

In a much simplified, schematic representation:

FIG. 1 is a hydraulic diagram of a hydraulic unit according to the invention;

FIG. 1*a* is a hydraulic diagram of another hydraulic unit according to the invention, including electric control lines and electromagnetic adjusting units;

FIG. 1*b* is a hydraulic diagram of a further hydraulic unit according to the invention, including first and second pump elements arranged relative to one another in the manner of a radial piston pump;

Figure 1A:
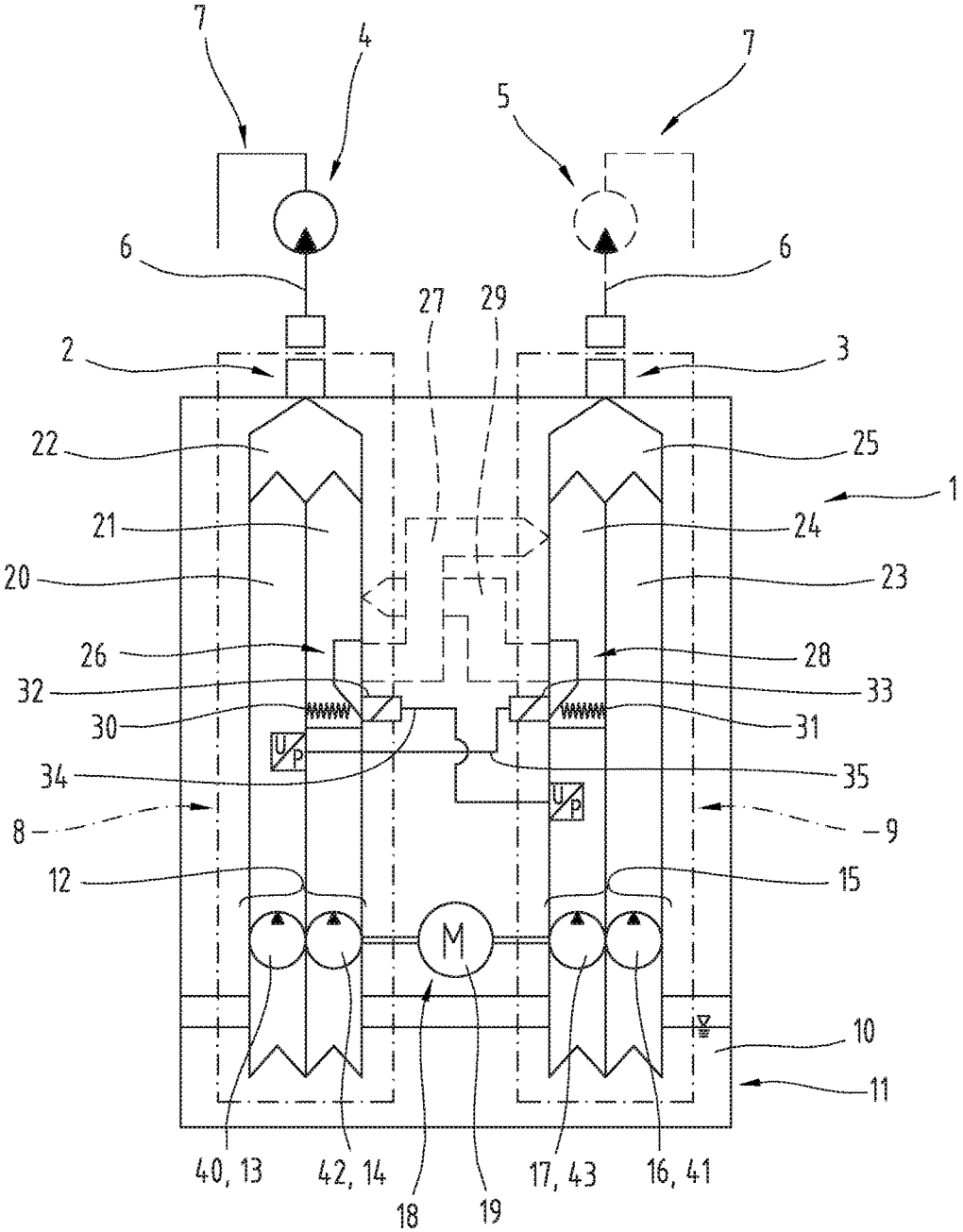

FIG. 1 shows in a much simplified and diagrammatic view a hydraulic unit 1 for the required supply of two or more hydraulically driven devices. The hydraulic unit 1 has in addition at least two pressure connections 2 and 3 and to the left pressure connection 2 in FIG. 1 a first device 4 can be connected, for example in the form of recovery cutters, a spreading cylinder or a spreading device. In FIG. 1 a second device 5 is also shown by dashed lines which can be connected to the right pressure connection 3. The devices 4, 5 each have a fluid supply 6, by means of which the volume flow supplied from the pressure connections 2, 3 is provided, and also comprise a fluid return 7, by means of which a volume flow is supplied back to the hydraulic unit 1. Details of the fluid return 7 to the devices 4, 5 and to the hydraulic unit 1 are not shown or explained in more detail at this point, as only simple return lines are necessary for this. To control the volume flow to the devices 4, 5 the latter are equipped e.g. with 4/3 valve switches, by means of which in the basic position of the valve in an idling state the circulation of the hydraulic fluid at low pressure is possible and in the additional valve settings two different directions of movement of the devices 4, 5 can be selected.

To supply the pressure connections 2, 3 the hydraulic unit 1 comprises two hydraulic circuits 8 and 9 indicated by dash-dotted lines, from which hydraulic fluid 10 is removed from a fluid container 11 and supplied to the pressure connections 2, 3. The first hydraulic circuit 8 comprises a first pump arrangement 12, which consists of at least two pump elements 13 and 14. Similarly, the second hydraulic circuit 9 comprises a second pump arrangement 15, which comprises at least two pump elements 16 and 17. The pump elements 13, 14, 16, 17 are based on the displacement principle and can thereby build up very high pressures, for example up to 1000 bar. Furthermore, the pump elements 13, 14, 16, 17 and possibly additional pump elements can be designed as part of a hydraulic pump in the form of a radial piston pump (schematically shown in FIG. 1*b*), axial piston pump or similar types of pumps with a plurality of displacer elements.

The pump elements 13, 14 of the first pump arrangement 12 and the pump elements 16, 17 of the second pump arrangement 15 are driven by a common drive 18, wherein the drive 18 can comprise an electric motor for example. For mobile use also the use of a combustion engine 19 is an advantage as a drive, as this provides a high spatial independence of current sources. The volume flows produced by the first pump elements 13 and 14 are guided via first fluid lines 20 and 21 to the first pressure connection 2, wherein the at least two first fluid lines 20 and 21 can also be combined in a first collecting line 22 ahead of the first pressure connection 2. Similarly, the volume flows produced by the second pump elements 16 and 17 are guided via second fluid lines 23 or 24 to the second pressure connection 3, whereby here too the second fluid lines 23 and 24 can be combined ahead of the second pressure connection 3 to a second collecting line 25. The fluid lines 20, 21 and 23, 24 are shown for clarifying the volume flows guided through the latter in the form of arrows.

To simplify the representation in FIG. 1 no fluid lines are shown in which the hydraulic fluid 10 is returned largely pressure-less to the fluid container 11 inside the hydraulic circuits 8 or 9 or by the devices 4 or 5.

In principle, at the first pressure connection 2 for the first device 4 the volume flow of the first pump arrangement 12, i.e. the first pump elements 13 and 14, is provided and similarly at the second pressure connection 3 for the second device 5 the volume flow of the second pump arrangement 15, i.e. of the second pump elements 16 and 17, is provided. If no device 4, 5 is connected to one of the pressure connections 2, 3, it needs to be ensured by measures known from the prior art that the volume flows produced by the pump elements 13, 14, 16, 17 are returned back to the fluid container 11 without damaging the hydraulic unit 1. This can be for example a pressure relief valve arranged ahead of the pressure connections 2, 3, which is activated manually, and the volume flows are supplied to the pressure connections 2, 3 only after connecting a device 4 or 5.

The potential output in a hydraulic circuit 8 or 9 is proportional to the product of the size of the volume flow and the level of the fluid pressure. As the output of the drive 18, for example of a combustion engine 19 used in the hydraulic unit 1 is limited, the volume flow provided at the pressure connections 2 or 3 is upwardly limited to provide an adjustable volume flow at a specific pressure. At a low counter pressure by means of the connected device 4 or 5 the volume flow is also delimited upwardly by the highest drive speed of the drive 18, for example by the highest speed of the combustion engine 19. In practice however, a largely constant drive speed can be assumed, which is why the pump arrangements 12, 15 deliver a largely constant total conveying amount and the latter, adapted to the drive output available, has to be divided into volume flows with different pressure levels.

It is known from the prior art in a generic hydraulic unit 1 to make it possible to divert the volume flow available in a hydraulic circuit 8 or 9 at least partly into the respective other hydraulic circuit 9 or 8, whereby the output of the drive 8 can be used more effectively and a volume flow can be used at a pressure connection 2 or 3, which exceeds the volume flow provided by the respective pump arrangement 12 or 15. In this way if no volume flow is required at one of the pressure connections 2 or 3, as no device is connected or the device is in an inactive state, at the other pressure connection an increased volume flow is provided, whereby with a connected device increased working speeds or acting forces can be achieved.

For this possible diversion of a volume flow from the first hydraulic circuit 8 to the second hydraulic circuit 9 the first hydraulic circuit 8 comprises a first valve switch 26, by means of which the first fluid line 21 can be connected via a first connecting line 27 to a second fluid line 24 in the second hydraulic circuit 9. Likewise, in the second hydraulic circuit 9 in a second fluid line 24 a second valve switch 28 is arranged and the second fluid line 24 can be connected via a second connecting line 29 to the first fluid line 21.

It is known from the prior art to use valve switches which are activated manually and for the correct allocation of the volume flows a manual switching process is necessary. In practice, hydraulic units known from the prior art are handled so that an operator using a recovery device gives a machinist at the hydraulic unit corresponding commands. For the correct allocation of the volume flows to the devices it is therefore necessary in the prior art to have a separate operator.

In a hydraulic unit 1 according to the invention for the correct allocation of the volume flows no separate operator is necessary, in that the valve switches 26 and 28 perform automated switching processes.

The valve switches 26, 28 also comprise a spring 30, 31 acting in the direction of an initial position and also comprise an actuator 32, 33, by means of which the volume flow is directed either to the respective pressure connection 2 or 3 or diverted via the connecting line 27 or 29 to the other hydraulic circuit 9 or 8. The first actuator 32 acting on the first valve switch 26 is controlled via a control line 34, which in the shown embodiment runs from the second hydraulic circuit 9 to the actuator 32 and the second actuator 33 acting on the second valve switch 28 is controlled via a control line 35, which runs in this embodiment from the first hydraulic circuit 8 to the actuator 33.

In the shown embodiment the switching position of the valve switch 30 is determined by the pressure in the second hydraulic circuit 9, as the control lines 34 and 35 consist of hydraulic control lines in which the pressure is transmitted in a fluid line of the respective other hydraulic circuit to the actuator of the valve switch of the other hydraulic circuit. By means of such a hydraulic unit 1 the volume flow provided at a pressure connection 2 or 3 can be increased by a pump element 17 or 14 of the other hydraulic circuit 9 or 8, whereby the operating speed of a connected device 4 or 5 can be increased without a manual adjustment of the valve switches 26, 28 being necessary.

Figure 1B:
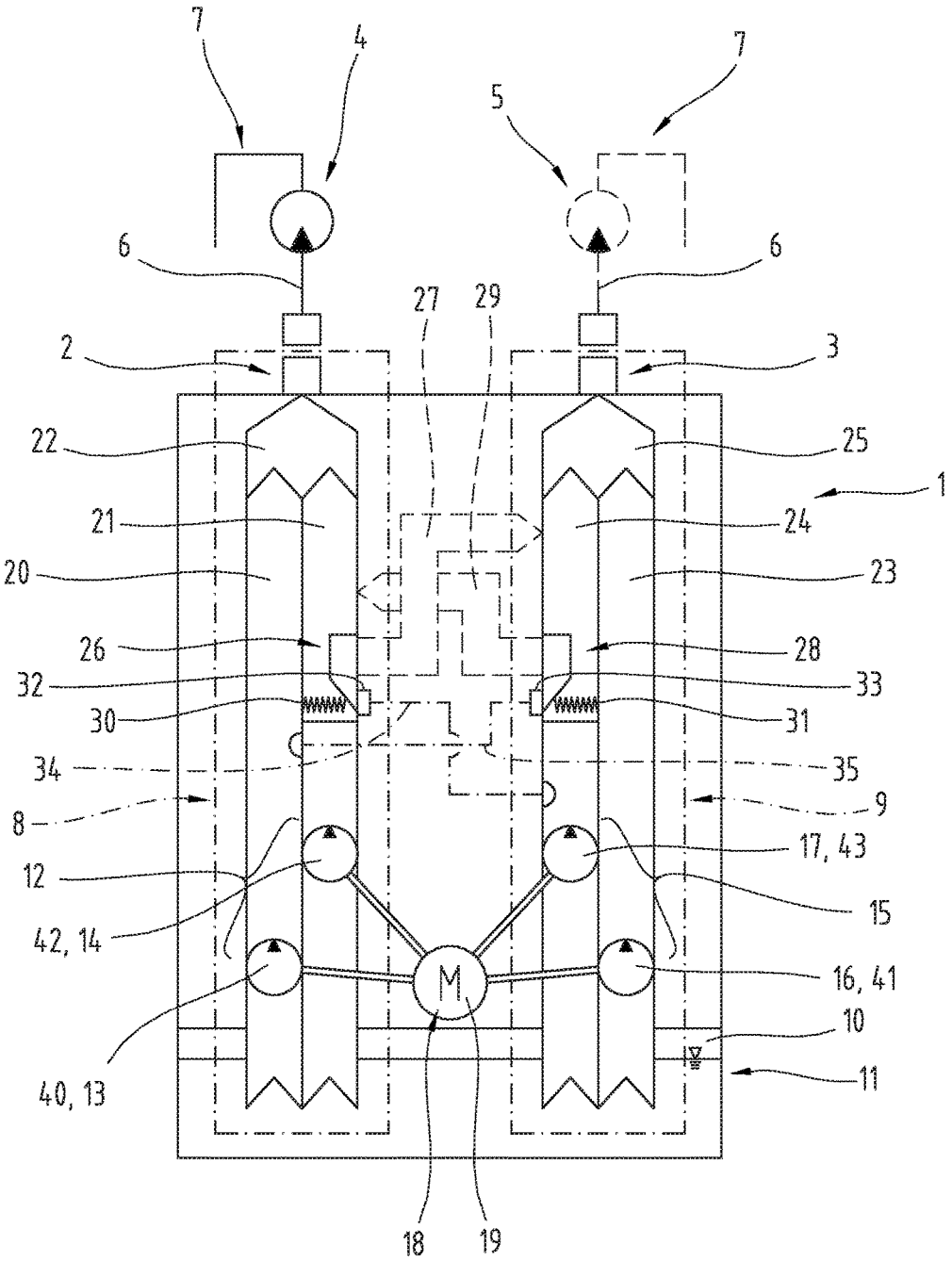

As schematically shown in FIG. 1*a*, the control lines 34 or 35 can also be electric control lines, by means of which status information can be transmitted from the respective other hydraulic circuit 9 or 8, e.g. pressure levels or switching positions on the devices 4, 5, to the actuator 32 or 33 of the relevant hydraulic circuit 8, 9 and the previously explained switching processes can be performed.

If for example the device 4 connected to the hydraulic unit 1 is a hydraulically driven rescue cylinder, during its use there are different operating states. In the idling state of the rescue cylinder the hydraulic fluid 10 at low pressure level can be guided to the switching valve of the rescue cylinder and from the latter back to the fluid tank 11. During the insertion or retraction of the rescue cylinder without loading there is only a low resistance, which is established in the internal friction of the rescue cylinder and in line resistance and said insertion and retraction movement takes place at a comparatively low pressure of up to about 30 bar. Said insertion or retraction movement should be able to be performed to save time at the greatest possible speed and therefore the provision of a large volume flow is an advantage and because of the relatively low pressure also the drive 18 can provide the necessary power.

Under external loading of the rescue cylinder the latter operates against a higher operating resistance and the required fluid pressure increases and also has to be provided by the hydraulic unit 1. The pressure level increases typically to up to 700 (1000) bar and because of the limited power of the drive 18 the volume flow under high pressure has to be reduced.

In the hydraulic unit 1 shown in FIG. 1 this can be performed for example in that with an increase in pressure at the pressure connection 2 only the volume flow of the first pump element 13 is guided to the pressure connection 2, whereas the volume flow of the pump element 14 is returned to the fluid container 11 via a pressure-controlled valve for example at a switching pressure of 150 to 250 bar. The pump element 14 in this way uses only a comparatively small amount of the drive power and thus a correspondingly higher amount of drive power is available for the pump element 13, which has to produce the high operating pressure.

In FIG. 1 the initial position of the valve switches 26 and 28, which is achieved by the springs 30 or 31, is such that the volume flow of the pump elements 14 and 17 remains in the relevant hydraulic circuit 8, 9 and is thus guided to the pressure connection 2 or 3. However, different embodiments are also possible.

The control lines 34 and 35 can also be electric control lines, by means of which electric signals from the other respective hydraulic circuit or from a connected device are transmitted to the actuator of the relevant hydraulic circuit. Electric control signals can be generated by switching elements on the connected device or by pressure voltage converters in the hydraulic circuit.

The actuators 32, 33 can be in the form for example of control pistons for hydraulic control lines 34, 35 or magnetic valves for electric control lines 34, 35 in corresponding valve switches.

Figure 2:
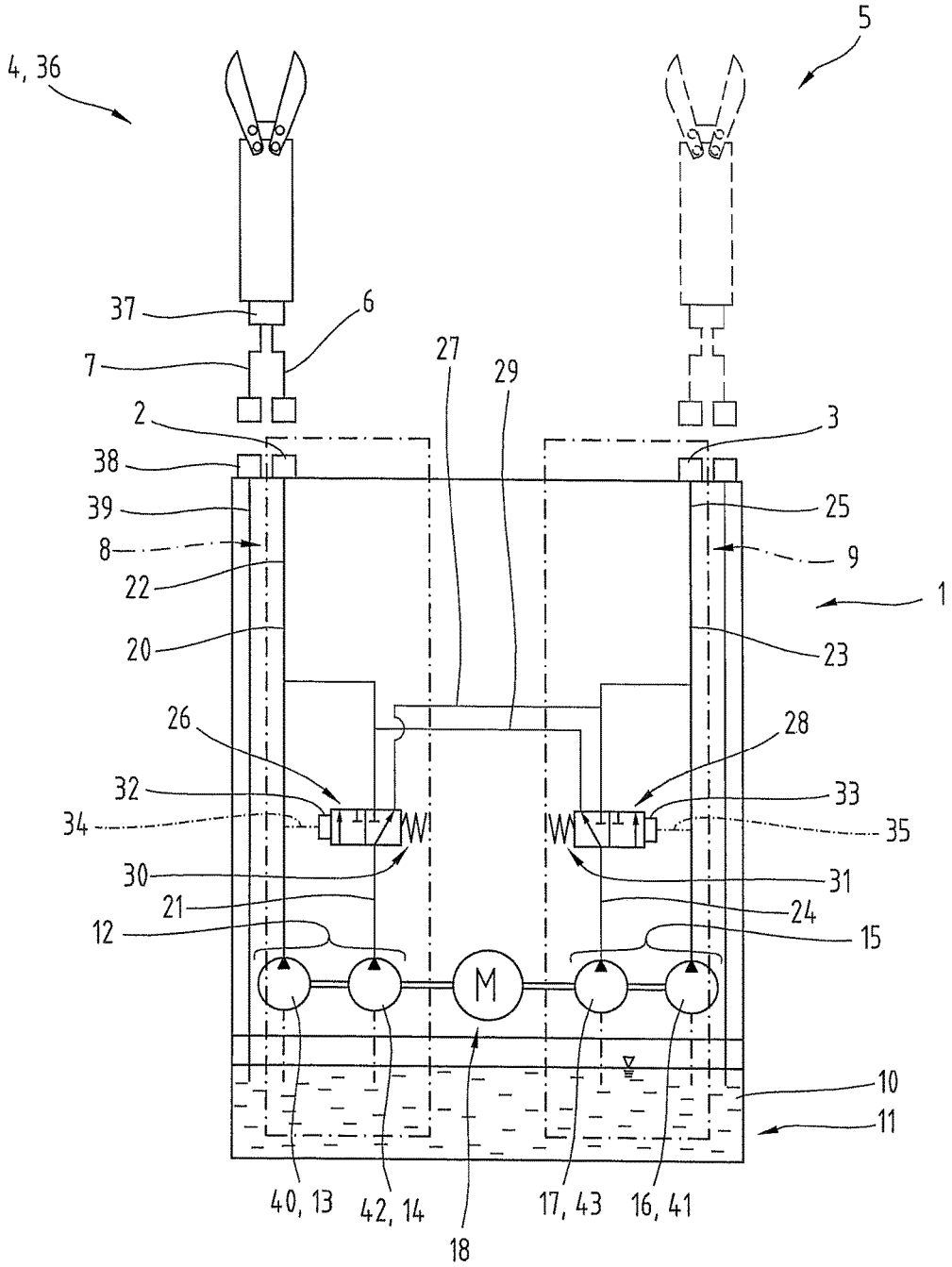
FIG. 2 is a hydraulic diagram of a further embodiment of a hydraulic unit.

FIG. 2 shows a diagram of a further embodiment of a hydraulic unit 1 according to the invention, wherein the components are denoted by the same reference numerals as in the embodiment described with reference to FIG. 1 and the components are not described again here.

The device 4 connectable to the hydraulic unit 1 is formed in the shown embodiment by a hydraulic recovery device 36 and comprises a double-acting hydraulic cylinder, in which a piston separates two working chambers inside the hydraulic cylinder. The direction of movement of the recovery device 36 depends on which of the working chambers the hydraulic fluid 10 supplied by the fluid supply 6 is guided through by means of a switching valve 37. The hydraulic fluid 10 displaced out of the respective other working chamber is returned by means of the fluid return 7 back to the hydraulic unit 1. With a connected device 4 the fluid circuit leads from the pressure connection 2 via the fluid supply 6, device 4 and fluid return 7 back to a return connection line 38 and return line 39 on the hydraulic unit 1 or directly back to the fluid container 11.

A second device 5 is indicated by dashed lines which can also be connected to the hydraulic unit 1.

The drive 18, the pump arrangements 12 and 15 as well as the fluid lines 20, 21, 23, 24 or collecting lines 22, 25 correspond to the embodiment described with reference to FIG. 1, but the lines in FIG. 2 are marked by dashes and not as in FIG. 1 by block arrows.

The embodiment according to FIG. 2 differs from the one in FIG. 1, in that the valve switches 26 and 28 are pushed by the springs 30 or 31 into an initial position, in which a flow path from the first fluid line 21 of the first hydraulic circuit 8 to the connecting line 27 to the other hydraulic circuit 9 is open. In this embodiment thus the volume flow supplied by the pump element 14 in the initial position of the valve switch 26 is diverted to the other hydraulic circuit 9. Similarly, in the second hydraulic circuit 9 the initial position of the valve switch 28 is such that the volume flow supplied by the pump element 17 is diverted to the first hydraulic circuit 8.

As the pump arrangements 12 and 15 usually have identical outputs, said "crossing" of volume flows between the two hydraulic circuits 8 and 9 does not have a noticeable effect on the volume flows or pressures provided at the pressure connections 2 or 3.

The actuator 32, by means of which the first valve switch 26 is switched against the effect of the spring 30 out of the initial position, is then addressed by a first control line 34, which in this embodiment comes from the first hydraulic circuit 8 itself, and from the first fluid line 20, which leads from the pump element 13 to the first pressure connection 2.

By means of this embodiment the first hydraulic circuit 8 with an increase in pressure in the fluid line 20 returns the volume flow diverted by the pump element 14 to the second hydraulic circuit 9 for its own use. Likewise, the second hydraulic circuit 9 can return the volume flow of the pump element 17 diverted in the initial position of the second valve switch 28 to the first hydraulic circuit 8 if necessary to its own pressure connection 3.

As already explained, by means of such a hydraulic unit 1 a device 4, 5 can be supplied with different pressure levels of the hydraulic fluids 10, wherein because of the predetermined output of the drive 18 at low pressure a greater volume flow can be provided and at high pressure only a small volume flow can be provided. To enable this individual pump elements for example the pump elements 14 and/or 17 when increasing the pressure level in the operating device can be diverted by means of a not shown valve directly to the fluid container 11 and in this way the conveying amount under pressure can be reduced.

It is also possible that the pump elements 13 and 14 of the pump arrangement 12 or the pump elements 16 and 17 of the pump arrangement 15 have varying outputs. At a specific drive intensity of the drive 18, for example a reference speed, it is possible that the pump element 14 has a greater output than the pump element 13 and is thus highly suitable for supplying with a large volume flow at a comparatively low pressure, whilst the smaller pump element 13 with its smaller output is optimally suitable for providing a comparatively small volume flow at high pressure. With regard to the configuration of such multiple pressure stage pumps reference is made to the relevant known prior art.

A hydraulic unit 1 according to the invention has for example the following conveying amounts, which are dependent on the respective operating situation. As the reference intensity of the drive 18 for example a speed of 3000/min is assumed. The two pump elements 13 and 16 of the hydraulic circuits 8, 9 have at this reference intensity a conveying amount of for example 0.7 l/min and the pump elements 14 and 17 for example a conveying amount of 2.0 l/min. The pump elements 13 and 16 can thus be referred to as high pressure elements 40 or 41 and the two larger pump elements 14 and 17 can be referred to as low pressure elements 42 or 43.

In an embodiment of the hydraulic unit according to FIG. 1 the following conveying amounts are defined during the use of two devices 4, 5. If two devices 4, 5 are connected to the pressure connections 2, 3, the latter are flowed through in an idling state at a pressure of up to about 20 bar. As the conveying amount the volume flow supplied at the pressure connection 2 by the pump arrangement 12 is a total of 2.7 l. Likewise the second device 5 is supplied by the pressure connection 3 with a volume flow of 2.7 l/min.

If for example at the device 4 an adjusting movement is introduced with low resistance the pressure increases to over 20 bar, whereby via the control line 35 a switching signal is sent to the second valve switch 28 and the volume flow of the pump element 17 is diverted to the first hydraulic circuit 8 and thereby at the first pressure connection 2 a conveying amount of 4.7 l/min is provided. In this way if only one device is activated, this can achieve a much higher operating speed. If for example the device 5 is also activated at a low operating resistance, because of the increase in pressure in the second fluid line 23 via the control line 34 a switching signal is transmitted to the first valve switch 26, wherein the switching process is activated by the actuator 32. In this way the volume flow supplied by the pump element 14 is diverted to the second hydraulic circuit 9 and in this operating state the devices 4, 5 are provided as in idling operation with a conveying amount of 2.7 l/min. The increased operating speed of the devices 4 or 5 can thus always be used automatically when only one of the devices 4, 5 is activated.

If a higher operating resistance occurs at one device 4, the volume flow supplied by the pump element 14 is diverted by means of a valve not shown in FIG. 2 to the fluid container 11 and the drive output of the drive 18 for the most part is available to the first pump element 13, by means of which at the reference speed of 3000/min a conveying amount of 0.7 l/min can be provided at the pressure connection 2. The pressure level is thus approximately between the switching pressure of below 250 bar, if exceeded the volume flow of the pump element 14 is switched off, and the system pressure of about 750 bar to 1000 bar delimited upwardly by a pressure limiting valve.

The main advantage of the hydraulic unit 1 according to the invention is that said switching processes do not have to be performed by an operator for the correct allocation of the volume flows to the pressure connections 2 and/or 3 but by the valve switches 26, 28.

In the embodiment shown in FIG. 2 the device 4 is supplied by the pressure connection 2 in an idling state with a conveying amount of 2.7 l/min, which is composed of a partial quantity of 0.7 l/min from the high pressure element 40 of the first hydraulic circuit 8 and a partial quantity of 2.0 l/min from the low pressure element 43 of the second hydraulic circuit. If there is an increase in pressure by activating the device 4 at a low working resistance in addition the volume flow of the low pressure element 42 is directed in a conveying amount of 2.0 l/min to the pressure connection 2, whereby a total of 4.7 l/min is available if no volume flow is necessary for a second device 5.

In FIGS. 1 and 2 measures known from the prior art which enable the two-stage pressure operation, for example pressure limiting valves, restricting valves, non-return valves etc. are not shown and described in more detail.

Figure 3:
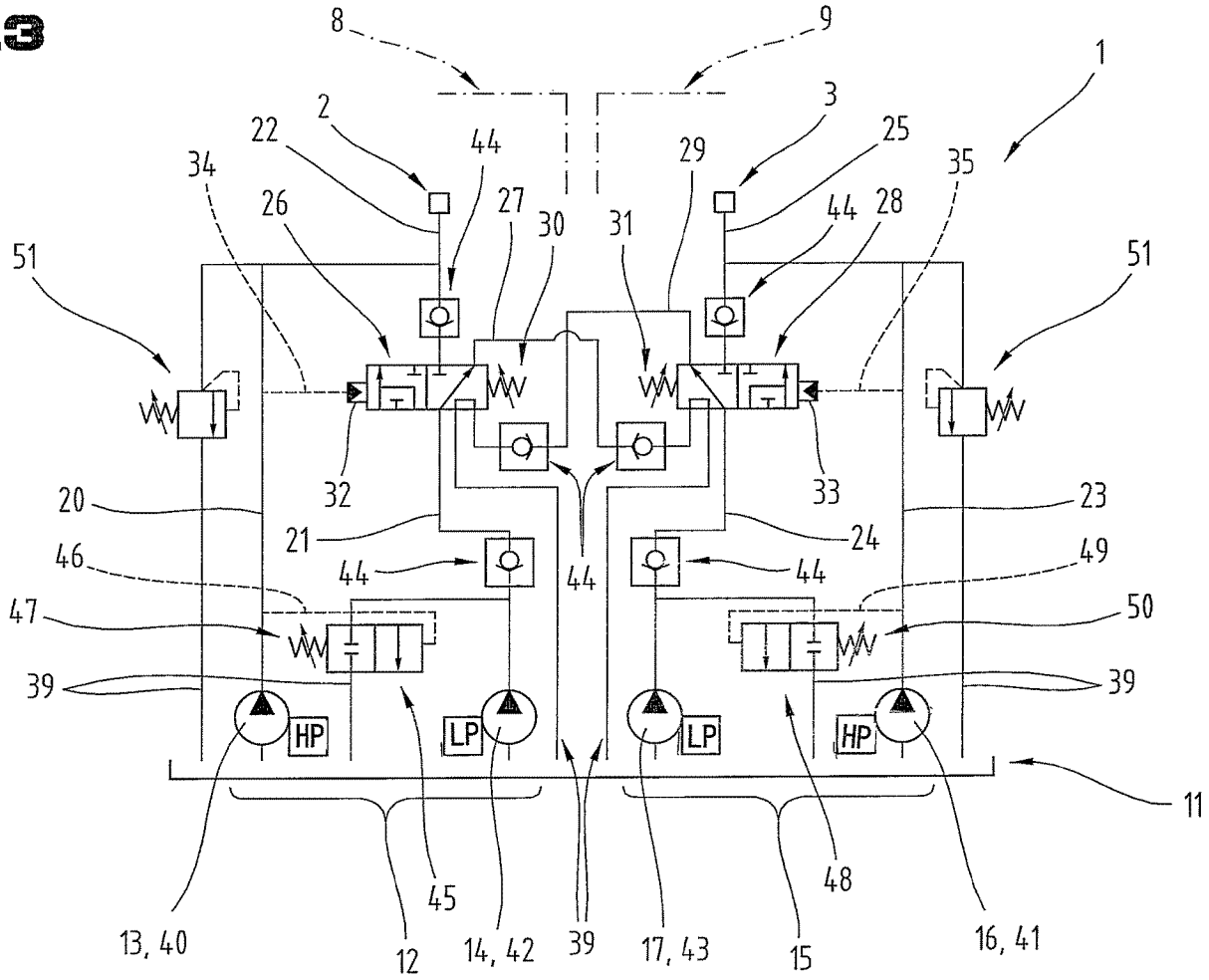
FIG. 3 is a hydraulic diagram of another embodiment of a hydraulic unit.

FIG. 3 shows in diagrammatic form a further independent embodiment of a hydraulic unit 1, wherein for the same parts the same reference numerals and components names are used as in the preceding FIGS. 1 and 2. To avoid unnecessary repetition reference is made to the description of the preceding FIGS. 1 and 2.

In this embodiment the connecting line 27 coming from the first hydraulic circuit 8 at the first valve switch 26 leads to the second valve switch 28 and in the latter the volume flow supplied via the connecting line 27 is diverted according to the switching position of the valve switch 28 either via a return line 39 into the fluid container 11 or via a flow path in the valve switch 28 combined with the volume flow supplied by the second pump element 17 in the second fluid line 24 and then provided via the second collecting line 25 at the second pressure connection 3.

Similarly, the connecting line 29 coming from the second hydraulic circuit 9 at the second valve switch 28 leads to the first valve switch in the first hydraulic circuit 8 and the volume flow supplied via the connecting line 29 according to the switching position of the valve 26 is either supplied via a return line 39 to the fluid container 11 or combined with the volume flow supplied by the pump element 14 and then provided via the collecting line 22 at the first pressure connection 2.

In addition, as shown, in the connecting lines 27, 29 non-return valves 44 can be provided, by means of which an unwanted flow direction reversal or propagation of pressure in an unwanted direction can be prevented.

Also in the pump elements 14 and 17, which as low pressure elements 42 and 43 are denoted by the symbol LP, in the fluid lines 21 and 24 coming from the latter non-return valve 44 can be provided. Furthermore, in the fluid lines between the valve switches 26, 28 and the pressure connections 2, 3 also a non-return valve 44 can be provided, so that with an increase in the pressure level at the pressure connections 2, 3 there is no propagation of pressure into the low pressure area.

The pump elements 13, 14, 16, 17 in FIG. 3 are, as already described with reference to FIGS. 1 and 2, provided with a not shown drive, by means of which the pump elements can be driven simultaneously. To adjust the conveying amounts provided at the pressure connections 2, 3 in the first hydraulic circuit 8 a pressure switching valve 45 is provided, by means of which the volume flow supplied by the volume element 14, i.e. a low pressure element 42, on exceeding a switching pressure is no longer directed to the pressure connection 2, but into the fluid container 11. The switching of the pressure switching valve 45 is activated by a control line 46 coming from the first fluid line 20, by means of which the fluid pressure at the pressure connection 2 is directed to the pressure switching valve 45 and this triggers a switching process by means of a not shown actuator, if because of an increasing pressure in the control line 46 a spring 47 activating the initial position of the pressure switching valve 45 is overcome.

In the second hydraulic circuit 9 similarly a pressure switching valve 48 is provided, by means of which the volume flow supplied by the second pump element 17 on exceeding a limit pressure is no longer directed to the second pressure connection 3 but into the fluid container 11. A control line 49 activating the switching thereby taps the pressure level existing between the second pump element 16, i.e. the high pressure element 41, and the second pressure connection 3 and if this is exceeded a restoring force activated by a spring 50 causes the diversion of the volume flow of the pump element 17 to the fluid container 11. The output of the drive in these cases is thus mainly available for the drive of the high pressure elements 40 and 41 and by means of the connected devices 4, 5 also high operating resistances can be overcome.

To protect the hydraulic unit 1 it is also possible that each hydraulic circuit 8, 9 is provided with a pressure limiting valve 51, which delimits the maximum pressure provided at the pressure connections 2 and 3 and the maximum pressure is determined so as to avoid the bursting of components of the hydraulic unit 1. The maximum pressure is set for example with an upper limit of 750 to 1000 bar.

The mode of operation of the valve switches 26, 28 corresponds in FIG. 3 essentially to that of the embodiment shown in FIG. 2, as here in their initial position the volume flow supplied by the pump element 14, 15 is directed to the other respective hydraulic circuit and during a switching process of the valve switch 26 or 28 because of an increase in pressure in the control line 34 or 35 the volume flow is returned to the related hydraulic circuit 8 or 9 and directed to the respective pressure connection 2 or 3.

In the shown embodiment both valve switches 26 and 28 are shown in the initial position and directly from the valve the volume flow diverted by the other respective hydraulic circuit 9 or 8 is returned via a return line 39 essentially without pressure into the fluid container 11. If for example at the pressure connection 2 a device 4 is activated and the fluid pressure increases as a result, by means of the control line 34 a switching process of the valve switch 26 is activated and in this case the volume flows of the pump elements 13, 14 and 17 are supplied to the pressure connection 2. This means there is an increased operating speed of a device 4 compared to a supply by only one hydraulic circuit 8.

If there an increase in pressure at the two pressure connections 2 and 3 by activating a connected device 4 or 5, no more hydraulic fluid is transmitted via the connecting lines 27 and 29 and each pressure connection 2, 3 respectively is supplied by the associated hydraulic circuit 8, 9 alone.

Figure 4:
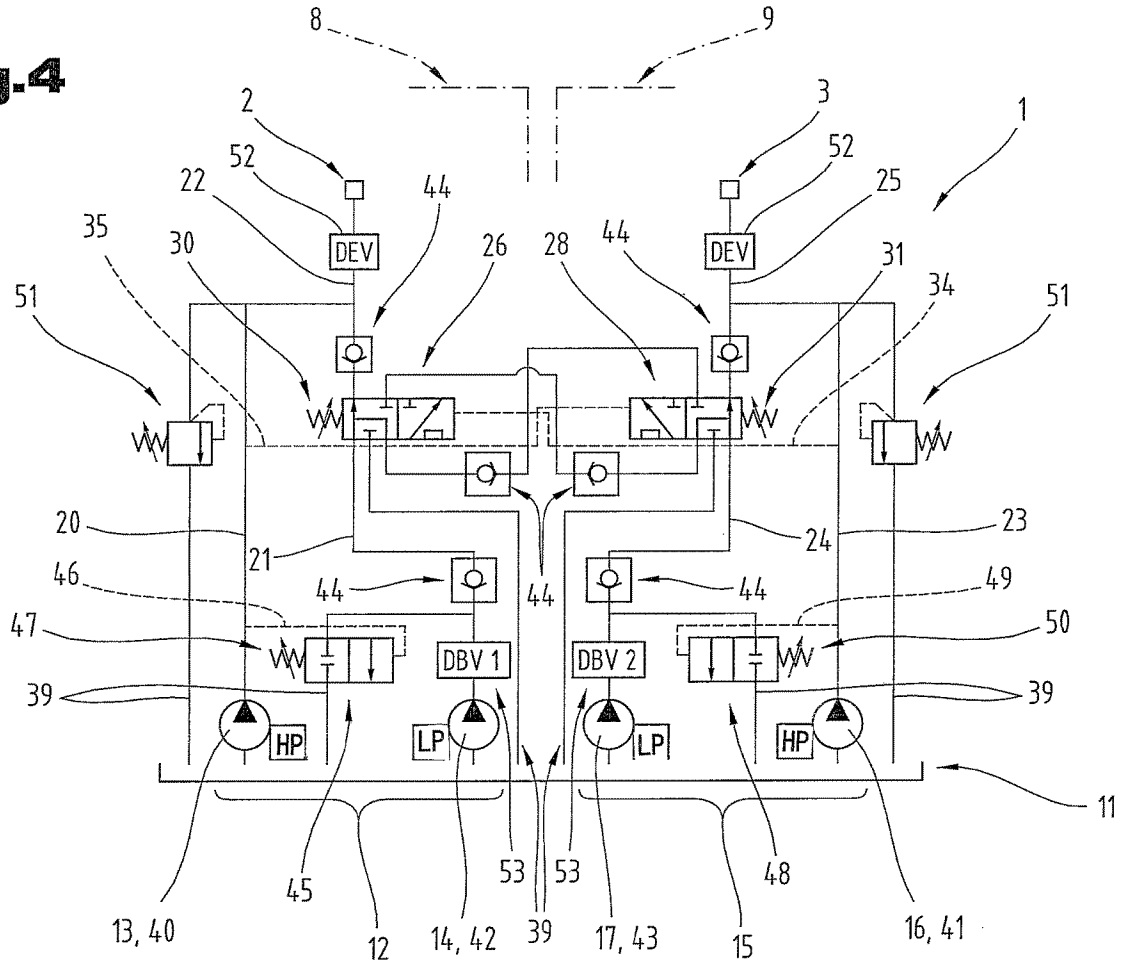
FIG. 4 is a hydraulic diagram of a further embodiment of a hydraulic unit.

FIG. 4 shows an additional and possibly independent embodiment of a hydraulic unit 1, wherein again for the same parts the same reference numerals and component names are used as in the preceding FIGS. 1 to 3. To avoid unnecessary repetition, reference is made to the detailed description of the preceding FIGS. 1 to 3.

The hydraulic unit 1 according to FIG. 4 differs from the embodiment in FIG. 3 in the integration of the valve switches 26 and 28, in which in the initial position produced by the springs 30 and 31 the volume flows supplied by the pump elements 14 and 17 are provided within the hydraulic circuit 8 and 9 at the respective pressure connection 2 and 3 and there is only a diversion of the volume flow with an increase in pressure in the other hydraulic circuit 9 or 8. The actuators, which are activated by the control lines 34 and 35, are not shown in FIG. 4 for reasons of space.

FIG. 4 also shows that optionally pressure relief valves 52 can be provided in the hydraulic circuits 8 and 9 in front of the pressure connections 2 and 3 by means of which a largely pressure-less return of hydraulic fluid to the fluid container 11 can be provided, if no device is connected to the respective pressure connection 2 and 3. Said pressure relief valves 53 which can also be used in other embodiments of the hydraulic unit 1 can be operated manually or can also be a component of a coupling system, in which in a coupling procedure both the fluid supply 6 and also the fluid return 7 of the device (cf. FIG. 1) are connected. The pressure relief valve 52 can in this case be designed as a bypass valve in the pressure connection 2 or 3.

In FIG. 4 it is also shown that a pressure limiting valve (DBV) 53 can be arranged downstream of the pump elements 14, 17, which can be designed as low pressure elements 42 and 43, which in the shown embodiment is effective when the hydraulic fluid is diverted from the valve switches 26 or 28 to the other respective hydraulic circuit 9 or 8 and in the latter because of high resistance a very high fluid pressure is available. The volume flow of the pump elements 42 and 43 can be diverted in this case via the pressure limiting valve 53 into the fluid container 11. The limit pressure, from which a pressure limiting valve 53 opens, is defined as a pressure which corresponds to the switching pressure of the pressure switching valves 45 or 48, as from this pressure level the volume flows of the low pressure elements 42, 43 are no longer directed to the pressure connections 2 or 3. A pressure limiting valve 53 can correspond structurally to the pressure switching valves 45, 48.

Figure 5:
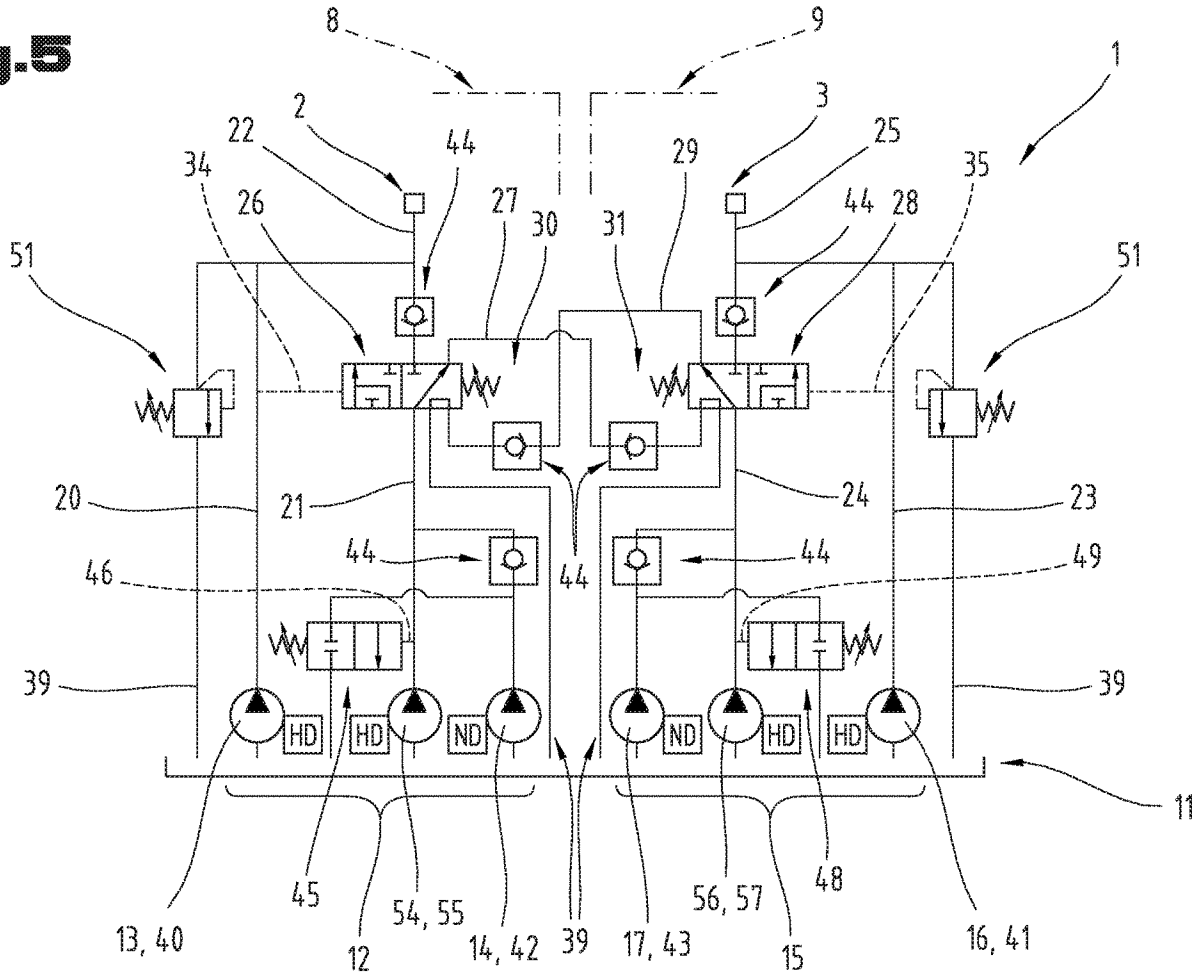
FIG. 5 is a hydraulic diagram of a further embodiment of a hydraulic unit and FIG. 6 is a hydraulic diagram of a further embodiment of a hydraulic unit.

In FIG. 5 an additional and independent embodiment of a hydraulic unit 1 is shown, wherein for the same parts the same reference numerals and component names are used as in the preceding FIGS. 1 to 4. To avoid unnecessary repetition reference is made to the detailed description of the preceding FIGS. 1 to 4.

In this embodiment the functioning of the valve switches 26 and 28 is as in the embodiment described with reference to FIG. 3 and a portion of the volume flow is diverted to the other hydraulic circuit 9 by a hydraulic circuit 8, in which no device is connected to the pressure connection 2 or the connected device is in an idling state. The first fluid line 21 leading to the valve switch 26 in this embodiment guides not only the volume flow of the pump element 14, but also the volume flow of an additional pump element 54 and can be diverted via the valve switch 26 to the other hydraulic circuit 9. Whereas the pump element 14 is designed as a low pressure element 42 which has a comparatively high conveying amount, the pump element 54 is designed as a high pressure element 55 which has a comparatively small conveying amount. In the shown position of the valve switch 26 in this way both volume flows of the pump elements 14 and 54 are diverted via the first connecting line 27 to the second hydraulic circuit 9. If in the latter no increased volume flow is required, as the connected device is in idling state, said diverted conveying amount is removed via the return line 39 to the fluid container 11. On an increase in pressure in the second hydraulic circuit 9 said volume flow is directed to the second pressure connection 3, as the second valve switch 28 is switched by the control line 35 of the second hydraulic circuit. At the pressure connection 3 thus the conveying amount of the second hydraulic circuits 9 increased by the conveying amount of the pump element 14 and 54 is available. With an additional increase in pressure in the second hydraulic circuit 9, which causes a transfer into the high pressure (HP) area, the volume flow of the pump element 14, which is designed as a low pressure element 42, is removed via the pressure switching valve 45 directly into fluid container 11 and only the volume flow of the pump element 54, which is in the form of a high pressure element 55, is diverted to the second hydraulic circuit 9. Thus also during high pressure operation at the second pressure connection 3 of the hydraulic circuit 9 a conveying amount is available increased by the volume flow of the high pressure element 55.

Similar to this in the second hydraulic circuit 9 an additional pump element 56 is arranged which is configured as a high pressure element 57 and the volume flow provided at the pressure connection 2 of the first hydraulic circuit 8 can be increased by the conveying amount of said high pressure element 57 and if necessary also by the volume flow of the low pressure element 43 in the second hydraulic circuit 9. By means of this embodiment, in which also at high resistance and high pressure a volume flow can be diverted from a non-active hydraulic circuit to the other hydraulic circuit, also with a high resistance the power of the drive 18 can be used optimally and the operating speed of a device can also be maximized even at high resistance.

The pressure switching valves 45 or 48 are controlled via control lines 46 and 49 by the fluid pressure acting on the high pressure elements 55 or 57.

Figure 6:
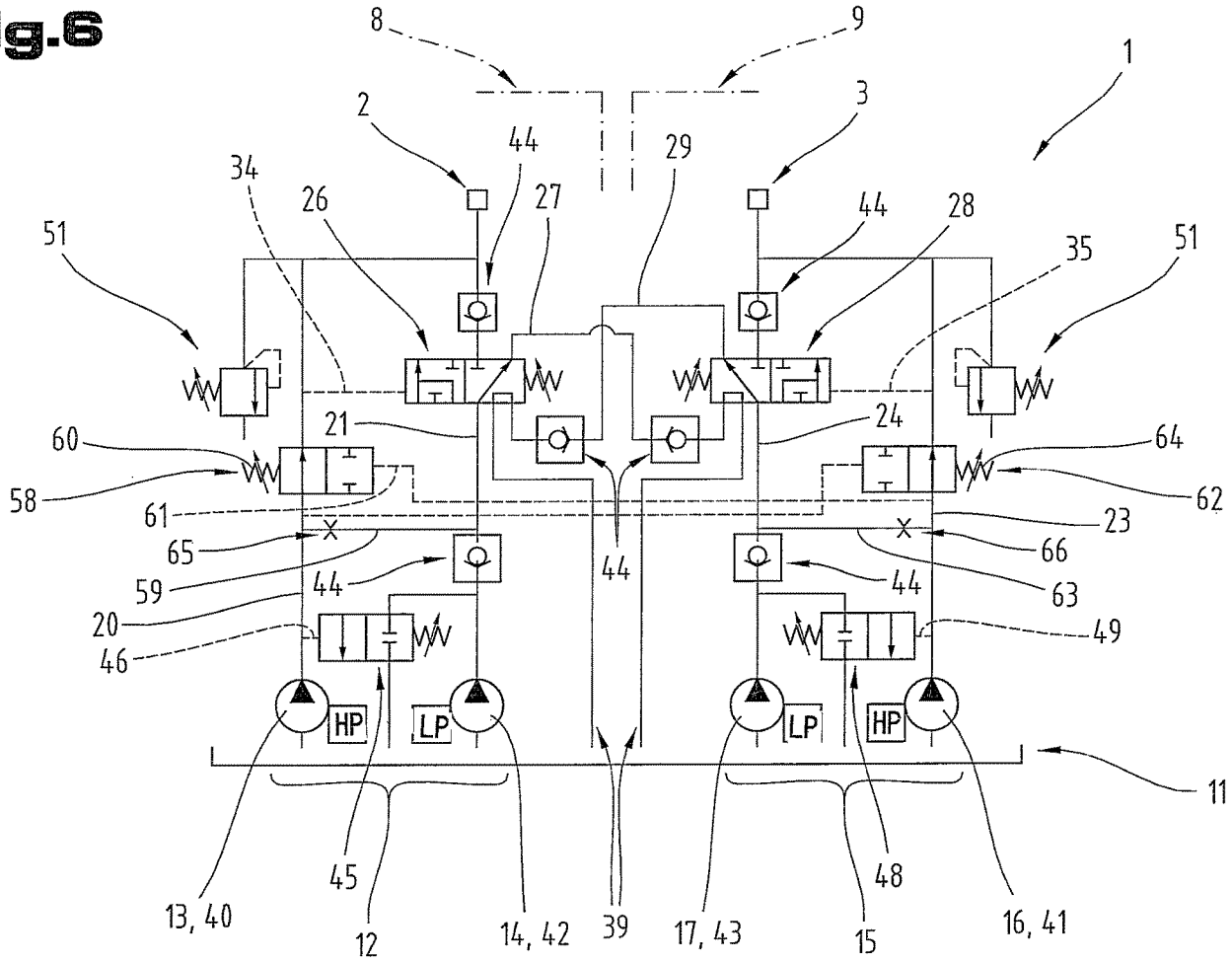

FIG. 6 shows an additional and if necessary independent embodiment of a hydraulic unit 1, wherein the same reference numerals and component names are used for the same parts as in the preceding FIGS. 1 to 5. To avoid unnecessary repetitions, reference is made to the detailed description of the preceding FIGS. 1 to 5.

In this embodiment of the hydraulic unit 1 the volume flow provided at the pressure connection can be increased if necessary by the conveying amount of all pump elements of another hydraulic circuit.

In the embodiment according to FIG. 6 for example the volume flow of the pump elements 13 and 14 can be diverted via the switch element 26 to the second hydraulic circuit 9, wherein the volume flow of the pump element 14, which can be designed as the low pressure element 42, is controlled according to the preceding embodiments. To divert the volume flow of the pump element 13, which is designed as a high pressure element 40, a stop valve 58 arranged in the first fluid line 20 is used and a transfer line 59 coming between the pump element 13 and stop valve 58 and leading to the additional first fluid line 21. The stop valve 58 is open in its starting position produced by a spring 60 and the volume flow of the pump element 13 can reach the pressure connection 2 of the first hydraulic circuit 8. The stop valve 58 is blocked by means of a control line 61, which leads from the second fluid line 23 in the second hydraulic circuit 9 to the stop valve 58. With an increase in pressure in the second hydraulic circuit 9 the first fluid line 20 is blocked by the pump element 13 to the pressure connection 2 and the volume flow of the pump element 13 is guided via the transfer line 59 to the valve switch 26, from which it then passes via the first connecting line 27 to the second hydraulic circuit 9. By means of a similar configuration of the second hydraulic circuit 9 with a stop valve 62, a transfer line 63 and a spring 64 in a similar manner the volume flow of the pump element 16 can be diverted to the first hydraulic circuit 8.

In this way also the volume flows of additional, not shown pump elements can be requested by the other respective hydraulic circuit and the conveying amount provided at the respective pressure connection can be increased accordingly.

Since both hydraulic circuits 8 and 9 in the shown embodiment have such a transfer or diverting function, only the hydraulic circuit temporarily requiring the volume flows of the other pump elements from the other hydraulic circuit can provide the increased conveying amount at the pressure connection. The activation of the stop valves 58, 62 is performed at a pressure of below 25 bar, whereby with non-activated, i.e. idling devices, at both pressure connections the required basic pressure is available and the device activated earlier receives the volume flow of all pump elements.

In the transfer lines 59 and 60 also advantageously flow restricting elements 65 and 66 are arranged, by means of which in the first fluid line 20 or the second fluid line 23 dynamic pressure is built up which is used for controlling the valve switches 26, 28 or the stop valves 58, 62 as required.

The hydraulic fluid 10 passes advantageously via suction lines from the fluid container 11 to the pump elements.

The exemplary embodiments show possible embodiment variants of the hydraulic unit 1, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, also individual features or combinations of features from the shown and described different embodiments can represent in themselves independent solutions according to the invention.

The underlying objective addressed by the independent solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Finally, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

Mainly the individual embodiments shown in FIGS. 1; 1*a*; 1*b*; 2; 3; 4; 5; 6 can form the subject matter of independent solutions according to the invention. The objectives and solutions according to the invention relating thereto can be taken from the detailed descriptions of these figures.

Finally, as a point of formality, it should be noted that for a better understanding of the structure of the hydraulic unit 1 the latter and its components have not been represented true to scale in part and/or have been enlarged and/or reduced in size.

| List of reference numerals |
|---|
| 1 hydraulic unit |
| 2 pressure connection |
| 3 pressure connection |
| 4 device |
| 5 device |
| 6 fluid supply |
| 7 fluid return |
| 8 hydraulic circuit |
| 9 hydraulic circuit |
| 10 hydraulic fluid |
| 11 fluid container |
| 12 pump arrangement |
| 13 pump element |
| 14 pump element |
| 15 pump arrangement |
| 16 pump element |
| 17 pump element |
| 18 drive |
| 19 combustion engine |
| 20 first fluid line |
| 21 first fluid line |
| 22 first collecting line |
| 23 second fluid line |
| 24 second fluid line |
| 25 second collecting line |
| 26 first valve switch |
| 27 first connecting line |
| 28 second valve switch |
| 29 second connecting line |
| 30 spring |
| 31 spring |

-continued

| List of reference numerals |
|---|
| 32 actuator |
| 33 actuator |
| 34 control line |
| 35 control line |
| 36 recovery device |
| 37 switching valve |
| 38 return connection line |
| 39 return line |
| 40 high pressure element |
| 41 high pressure element |
| 42 low pressure element |
| 43 low pressure element |
| 44 non-return valve |
| 45 pressure switching valve |
| 46 control line |
| 47 spring |
| 48 pressure switching valve |
| 49 control line |
| 50 spring |
| 51 pressure limiting valve |
| 52 pressure relief valve |
| 53 pressure limiting valve |
| 54 pump element |
| 55 high pressure element |
| 56 pump element |
| 57 high pressure element |
| 58 stop valve |
| 59 transfer line |
| 60 spring |
| 61 control line |
| 62 stop valve |
| 63 transfer line |
| 64 spring |
| 65 flow restricting element |
| 66 flow restricting element |

The invention claimed is:

1. A hydraulic unit comprising:

at least a first pressure connection and a second pressure connection for the required supply of one or more hydraulically driven devices with hydraulic fluid from a fluid container, a first hydraulic circuit comprising:

a first pump arrangement comprising at least two first pump elements, and first fluid lines leading from the at least two first pump elements to the first pressure connection, at least one second hydraulic circuit comprising:

a second pump arrangement comprising at least two second pump elements, and second fluid lines leading to the second pressure connection, a drive configured to drive the first pump elements and the second pump elements at the same time, a first connecting line, a first valve switch configured to connect at least one of the first fluid lines via the first connecting line to one of the second fluid lines in the second hydraulic circuit, the first valve switch comprising a first valve switch spring acting in a direction of a first valve switch initial position, a second connecting line, a second valve switch configured to connect at least one of the second fluid lines via the second connecting line to one of the first fluid lines in the first hydraulic circuit, the second valve switch comprising a second valve switch spring acting in a direction of a second valve switch initial position, a first actuator acting on the first valve switch, a first control line running from the first hydraulic circuit or from the second hydraulic circuit to the first actuator, a second actuator acting on the second valve switch, and a second control line running from the second hydraulic circuit or from the first hydraulic circuit to the second actuator, wherein the first pump elements comprise at least one high pressure element with a smaller conveying amount at a reference intensity of the drive, the at least one high pressure element being arranged in a first fluid line of the first fluid lines, and at least one low pressure element with a larger conveying amount at the reference intensity, the at least one low pressure element being arranged in a second fluid line of the first fluid lines, wherein the second pump elements comprise at least one high pressure element with a smaller conveying amount, the at least one high pressure element being arranged in a first fluid line of the second fluid lines, and at least one low pressure element with a larger conveying amount, the at least one low pressure element being arranged in a second fluid line of the second fluid lines, and wherein the first and the second valve switches are arranged in the second fluid lines, respectively, coming from the low pressure elements, and wherein the conveying amount of the at least one low pressure element of the first pump elements is at least double the conveying amount of the at least one high pressure element of the first pump elements.

2. The hydraulic unit as claimed in claim 1, wherein the first control line is designed as a hydraulic control line and acts directly or via a pilot valve on the first valve switch.

3. The hydraulic unit as claimed in claim 1, wherein the first control line is designed as an electric control line and via an electromagnetic adjusting unit acts directly or with a pilot element on the first valve switch.

4. The hydraulic unit as claimed in claim 1, wherein in the first valve switch initial position the first valve switch opens a flow path from one of the first fluid lines to the first connecting line to the second hydraulic circuit.

5. The hydraulic unit as claimed in claim 1, wherein all of the first fluid lines are connected via at least the first valve switch and via at least the first connecting line to at least one of the second fluid lines of the second hydraulic circuit and/or all of the second fluid lines are connected via at least the second valve switch and via at least the second connecting line to at least one of the first fluid lines of the first hydraulic circuit.

6. The hydraulic unit as claimed in claim 1, wherein in one of the first fluid lines of the first hydraulic circuit following a pump element of the at least two first pump elements a pressure switching valve is arranged, wherein the pressure switching valve is controlled by a pressure control line coming from another of the first fluid lines of the first hydraulic circuit, and wherein with an increase in pressure in the other of the first fluid lines from the pressure switching valve a flow path is created from the pump element to the fluid container.

7. The hydraulic unit as claimed in claim 1, wherein the at least two first pump elements and the at least two second pump elements are arranged relative to one another in the manner of a radial piston pump.

8. The hydraulic unit as claimed in claim 1, wherein suction lines lead from the at least two first pump elements into the fluid container.

9. The hydraulic unit as claimed in claim 1, wherein the second control line is designed as a hydraulic control line and acts directly or via a pilot valve on the second valve switch.

10. The hydraulic unit as claimed in claim 1, wherein the second control line is designed as an electric control line and via an electromagnetic adjusting unit acts directly or with a pilot element on the second valve switch.

11. The hydraulic unit as claimed in claim 1, wherein in the second valve switch initial position, the second valve switch opens a flow path from one of the second fluid lines to the second connecting line to the first hydraulic circuit.

12. A method for supplying up to at least two hydraulically driven devices, with hydraulic fluid via a hydraulic unit with at least two pressure connections, the method comprising steps of:

combining via first fluid lines in a first hydraulic circuit, with a first pump arrangement, volume flows from at least two first pump elements to form a first combined flow, directing the first combined flow to a first pressure connection, combining via second fluid lines in a second hydraulic circuit, with a second pump arrangement, volume flows of at least two second pump elements to form a second combined flow, directing the second combined flow to a second pressure connection, driving the first pump elements and the second pump elements at the same time by a common drive, switching the volume flow from one of the first fluid lines to the second hydraulic circuit for required allocation of the volume flows to the first and the second pressure connections, the switching occurring via a first valve switch switching the volume flow from the one of the first fluid lines via a first connecting line to one of the second fluid lines in the second hydraulic circuit, the switching occurring as a spring of the first valve switch is moved via a first actuator, the first actuator being controlled by a first control line coming from the first hydraulic circuit or from the second hydraulic circuit, and switching the volume flow from one of the second fluid lines to the first hydraulic circuit for required allocation of the volume flows to the first and the second pressure connections, the switching occurring via a second valve switch switching the volume flow from the one of the second fluid lines via a second connecting line to one of the first fluid lines in the first hydraulic circuit, the switching occurring as a spring of the second valve switch is moved by a second actuator, the second actuator being controlled by a second control line coming from the second hydraulic circuit or from the first hydraulic circuit, wherein the first pump elements comprise at least one high pressure element with a smaller conveying amount at a reference intensity of the drive, the at least one high pressure element being arranged in a first fluid line of the first fluid lines, and at least one low pressure element with a larger conveying amount at the reference intensity, the at least one low pressure element being arranged in a second fluid line of the first fluid lines, wherein the second pump elements comprise at least one high pressure element with a smaller conveying amount, the at least one high pressure element being arranged in a first fluid line of the second fluid lines, and at least one low pressure element with a larger conveying amount, the at least one low pressure element being arranged in a second fluid line of the second fluid lines, and wherein the first and the second valve switches are arranged in the second fluid lines, respectively, coming from the low pressure elements, and wherein the conveying amount of the low pressure element of the first pump elements is at least double the conveying amount of the high pressure element of the first pump elements.

13. A hydraulic unit comprising:

at least a first pressure connection and a second pressure connection for the required supply of one or more hydraulically driven devices with hydraulic fluid from a fluid container, a first hydraulic circuit comprising:

a first pump arrangement comprising at least two first pump elements, and first fluid lines leading from the at least two first pump elements to the first pressure connection, at least one second hydraulic circuit comprising:

a second pump arrangement comprising at least two second pump elements, and second fluid lines leading to the second pressure connection, a drive configured to drive the first pump elements and the second pump elements at the same time, a first connecting line, a first valve switch configured to connect at least one of the first fluid lines via the first connecting line to one of the second fluid lines in the second hydraulic circuit, the first valve switch comprising a first valve switch spring acting in a direction of a first valve switch initial position, a second connecting line, a second valve switch configured to connect at least one of the second fluid lines via the second connecting line to one of the first fluid lines in the first hydraulic circuit, the second valve switch comprising a second valve switch spring acting in a direction of a second valve switch initial position, a first actuator acting on the first valve switch, a first control line running from the first hydraulic circuit or from the second hydraulic circuit to the first actuator, a second actuator acting on the second valve switch, and a second control line running from the second hydraulic circuit or from the first hydraulic circuit to the second actuator, wherein the first connecting line runs from the first valve switch to the second valve switch and the second connecting line runs from the second valve switch to the first valve switch, wherein the second valve switch in a first switching position forms a flow path from the first connecting line to one of the second fluid lines leading to the second pressure connection, wherein the second valve switch in a further switching position forms a flow path to the fluid container, wherein the first valve switch in a pressure connection switching position forms a flow path from the second connecting line to one of the first fluid lines leading to the first pressure connection, and wherein the first valve switch in a fluid container switching position forms a flow path to the fluid container.

14. The hydraulic unit as claimed in claim 13, wherein the first hydraulic circuit comprises at least a first high pressure element and a second high pressure element, wherein the first high pressure element is connected via one of the first fluid lines directly to the first pressure connection, and wherein the first valve switch is configured to connect the second high pressure element to the second hydraulic circuit.

15. A hydraulic unit comprising:

at least a first pressure connection and a second pressure connection for the required supply of one or more hydraulically driven devices with hydraulic fluid from a fluid container, a first hydraulic circuit comprising:

a first pump arrangement comprising at least two first pump elements, and first fluid lines leading from the at least two first pump elements to the first pressure connection, at least one second hydraulic circuit comprising:

a second pump arrangement comprising at least two second pump elements, and second fluid lines leading to the second pressure connection, a drive configured to drive the first pump elements and the second pump elements at the same time, a first connecting line, a first valve switch configured to connect at least one of the first fluid lines via the first connecting line to one of the second fluid lines in the second hydraulic circuit, the first valve switch comprising a first valve switch spring acting in a direction of a first valve switch initial position, a second connecting line, a second valve switch configured to connect at least one of the second fluid lines via the second connecting line to one of the first fluid lines in the first hydraulic circuit, the second valve switch comprising a second valve switch spring acting in a direction of a second valve switch initial position, a first actuator acting on the first valve switch, a first control line running from the first hydraulic circuit or from the second hydraulic circuit to the first actuator, a second actuator acting on the second valve switch, and a second control line running from the second hydraulic circuit or from the first hydraulic circuit to the second actuator, wherein the first pump elements comprise at least one high pressure element with a smaller conveying amount at a reference intensity of the drive, the at least one high pressure element being arranged in a first fluid line of the first fluid lines, and at least one low pressure element with a larger conveying amount at the reference intensity, the at least one low pressure element being arranged in a second fluid line of the first fluid lines, wherein the second pump elements comprise at least one high pressure element with a smaller conveying amount, the at least one high pressure element being arranged in a first fluid line of the second fluid lines, and at least one low pressure element with a larger conveying amount, the at least one low pressure element being arranged in a second fluid line of the second fluid lines, and wherein the first and the second valve switches are arranged in the second fluid lines, respectively, coming from the low pressure elements, and wherein the conveying amount of the at least one low pressure element of the second pump elements is at least double the conveying amount of the at least one high pressure element of the second pump elements.

* * * * *